US009051756B1

(12) United States Patent
Jenkins

(10) Patent No.: US 9,051,756 B1
(45) Date of Patent: Jun. 9, 2015

(54) COLLAPSIBLE SUNSHADE

(71) Applicant: John D. Jenkins, Naples, FL (US)

(72) Inventor: John D. Jenkins, Naples, FL (US)

( * ) Notice: Subject to any disclaimer, the term of this patent is extended or adjusted under 35 U.S.C. 154(b) by 0 days.

(21) Appl. No.: 13/653,725

(22) Filed: Oct. 17, 2012

Related U.S. Application Data

(60) Provisional application No. 61/548,560, filed on Oct. 18, 2011.

(51) Int. Cl.
*E04H 15/58* (2006.01)
*E04H 15/00* (2006.01)

(52) U.S. Cl.
CPC ..... *E04H 15/58* (2013.01); *E04H 15/003* (2013.01)

(58) Field of Classification Search
CPC ..... E04H 15/58; E04H 15/003; A45B 2023/0006; A45B 2023/0093
USPC ..... 135/93, 99, 114, 115, 117, 87, 900
See application file for complete search history.

(56) References Cited

U.S. PATENT DOCUMENTS

| | | | | | |
|---|---|---|---|---|---|
| 1,785,953 | A | * | 12/1930 | Hanan | 5/418 |
| 2,124,842 | A | | 7/1938 | Zierold et al. | |
| 2,190,566 | A | * | 2/1940 | Julian | 135/95 |
| 2,521,768 | A | * | 9/1950 | Adams | 135/95 |
| 2,660,186 | A | * | 11/1953 | Marshall et al. | 135/153 |
| 2,970,600 | A | * | 2/1961 | Schultz | 135/140 |
| 3,042,053 | A | * | 7/1962 | Gabriel | 135/130 |
| 3,070,107 | A | * | 12/1962 | Beatty | 135/87 |
| 3,075,536 | A | * | 1/1963 | Parker | 135/87 |
| 3,404,696 | A | * | 10/1968 | De Souza Filho | 135/91 |
| 3,785,388 | A | | 1/1974 | Schafer | |
| 4,506,688 | A | * | 3/1985 | Bethoon et al. | 135/140 |
| 4,924,893 | A | | 5/1990 | Furey | |
| 4,930,534 | A | * | 6/1990 | Hill | 135/136 |
| 5,080,123 | A | * | 1/1992 | Stein | 135/97 |
| 5,122,014 | A | | 6/1992 | Genfan | |
| 5,207,406 | A | | 5/1993 | Stine et al. | |
| 5,299,590 | A | * | 4/1994 | Deibert et al. | 135/125 |
| 5,452,877 | A | | 9/1995 | Riffle et al. | |
| 5,546,971 | A | * | 8/1996 | Leonhardt | 135/127 |
| 5,636,944 | A | | 6/1997 | Buttimore | |
| 5,823,217 | A | * | 10/1998 | Rice | 135/124 |
| 6,164,613 | A | | 12/2000 | Williams | |
| 6,354,554 | B1 | | 3/2002 | Hollenbeck | |
| 6,443,172 | B2 | | 9/2002 | Brumfield | |
| 6,446,649 | B1 | | 9/2002 | Bigford | |

(Continued)

FOREIGN PATENT DOCUMENTS

WO WO 0204768 A1 * 1/2002

*Primary Examiner* — Noah Chandler Hawk
(74) *Attorney, Agent, or Firm* — Livingston Loeffler, P.A.; Edward M. Livingston, Esq.; Bryan L. Loeffler, Esq.

(57) ABSTRACT

A collapsible sunshade (1) that uses a simple support structure and anchoring system to simplify the carrying, assembly and disassembly of the sunshade. The collapsible sunshade of has a substantially-rectangular shaped canopy (3) with one or more pockets (9) located near a rear edge (6) of the canopy. The pockets may be filled with sand to anchor the rear edge of the collapsible sunshade to the ground. One or more air vents (10) may also be located proximal to the rear edge to allow wind to pass through, thereby lessening the pressure of the wind on a bottom surface (8) of the canopy. A front support structure (18) and optional rear support structure (2) in combination with wind supports the body of the canopy, which acts like a sail in the wind.

9 Claims, 4 Drawing Sheets

(56) References Cited

U.S. PATENT DOCUMENTS

| | | | | |
|---|---|---|---|---|
| 6,866,053 | B2 | 3/2005 | You | |
| 7,246,629 | B2 | 7/2007 | You | |
| 7,406,975 | B1 | 8/2008 | Carrier, Jr. | |
| 7,690,390 | B2 * | 4/2010 | Hopkins et al. | 135/88.03 |
| 7,780,139 | B2 | 8/2010 | Market | |
| 7,789,097 | B1 * | 9/2010 | Sotirkys et al. | 135/88.01 |
| D625,508 | S | 10/2010 | Thurrott et al. | |
| 2001/0035201 | A1 | 11/2001 | Kuzmic | |
| 2004/0226591 | A1 | 11/2004 | You | |
| 2006/0016950 | A1 | 1/2006 | Bright et al. | |
| 2008/0236640 | A1 | 10/2008 | Huali et al. | |
| 2010/0101614 | A1 | 4/2010 | Wang et al. | |
| 2012/0291830 | A1 * | 11/2012 | Crimi | 135/117 |
| 2014/0041703 | A1 * | 2/2014 | Funston | 135/121 |

* cited by examiner

COLLAPSIBLE SUNSHADE

CROSS REFERENCE TO RELATED APPLICATION

This application claims the benefit of U.S. Provisional Patent Application No. 61/548,560, filed Oct. 18, 2011. The patent application identified above is incorporated herein by reference in its entirety to provide continuity of disclosure.

FIELD OF THE INVENTION

This invention relates to portable shelters such as sun shades, umbrellas, canopies and the like and more particularly relates to an easily transportable sun shade which can be quickly set up to provide users with protection from the sun.

BACKGROUND OF THE INVENTION

Portable shelters such as umbrellas, canopies and tents are very popular due to the detrimental effects of the sun. Conventional umbrellas provide only limited protection based on the size and the circular shape of the umbrella. In addition, umbrellas are fragile and have tendency to flip inside out in strong winds. Alternatively, conventional canopies and tents are require multiple individuals to erect and require multiple tie downs or anchors to prevent the canopies from blowing over, thereby making assembly and take down complicated. A further problem with tents is the lack of air flow. Most importantly, the wind works against umbrellas, canopies and tents by blowing over and/or damaging umbrellas, canopies and tents.

Therefore, a need exists for a collapsible sunshade that is easy to transport, easy to assemble, easy to disassemble, provides an adequate area of shade for one or more users and uses the wind to inflate and support the sunshade as opposed to blowing over the sunshade.

The relevant prior art includes the following references:

| Patent No. (U.S. Patent References) | Inventor | Issue/Publication Date |
|---|---|---|
| D625508 | Thurrott et al. | Oct. 19, 2010 |
| 2010/0101614 | Wang et al. | Apr. 29, 2010 |
| 2008/0236640 | Huali et al. | Oct. 2, 2008 |
| 7,406,975 | Carrier, Jr. | Aug. 5, 2008 |
| 7,780,139 | Market | Aug. 24, 2010 |
| 2006/0016950 | Bright et al. | Jan. 26, 2006 |
| 7,246,629 | You | Jul. 24, 2007 |
| 2004/0226591 | You | Nov. 18, 2004 |
| 6,866,053 | You | Mar. 15, 2005 |
| 2001/0035201 | Kuzmic | Nov. 1, 2001 |
| 6,443,172 | Brumfield | Sep. 3, 2002 |
| 6,446,649 | Bigford | Sep. 10, 2002 |
| 6,354,554 | Hollenbeck | Mar. 12, 2002 |
| 6,164,613 | Williams | Dec. 26, 2000 |
| 5,636,944 | Buttimore | Jun. 10, 1997 |
| 5,452,877 | Riffle et al. | Sep. 26, 1995 |
| 5,207,406 | Stine et al. | May 4, 1993 |
| 5,122,014 | Genfan | Jun. 16, 1992 |
| 4,924,893 | Furey | May 15, 1990 |
| 3,785,388 | Schafer | Jan. 15, 1974 |
| 2,124,842 | Zierold et al. | Jul. 26, 1938 |

SUMMARY OF THE INVENTION

The primary object of the present invention is to provide a collapsible sunshade that is easy to carry and transport to and from the beach or other outdoor areas.

An additional object of the present invention is to provide a collapsible sunshade that is easy to assemble.

A further object of the present invention is to provide a collapsible sunshade that is easy to disassemble.

An additional object of the present invention is to provide a collapsible sunshade that uses the wind to help inflate and support the sunshade as opposed to blowing over the sunshade.

The present invention fulfills the above and other objects by providing a collapsible sunshade that uses a simple support structure and anchoring system to simplify the assembly and disassembly of the sunshade. The collapsible sunshade of the present invention has a substantially-rectangular shaped canopy having a front edge, side edges, a rear edge a top surface and a bottom surface. One or more pockets are located proximal to the rear edge of the canopy. The pockets may be filled with sand or other substances such as gravel to anchor the rear edge of the collapsible sunshade to the ground. One or more air vents may also be located proximal to the rear edge to allow wind to pass through, thereby lessening the pressure of the wind on the bottom surface of the canopy. A front sleeve is located along the front edge of the canopy that houses a front crossbeam. The front cross beam is may be one elongated member or multiple elongated members connected together depending on the desired length. One or more front support poles attach to the front crossbeam by passing through one or more apertures located on the front sleeve and the front crossbeam. The one or more front support poles may be telescoping to allow a user to adjust the height of the front crossbeam. The body of the canopy is supported by wind blowing under the front crossbeam and against the bottom surface of the canopy thereby elevating a rear portion of the canopy and causing the canopy to act like a sail. The rear portion of the canopy may also be supported by a rear crossbeam that is housed by a rear sleeve extending between the sides of the canopy. One or more rear support poles attach to the rear crossbeam by passing through one or more apertures located on the rear sleeve and the rear crossbeam. The one or more rear support poles may also be telescoping to allow a user to adjust the height of the rear crossbeam.

An additional advantage of the collapsible sunshade of the present invention is the compact storage of the sunshade. After removing the front support poles and rear support poles, the poles may be placed parallel to the front edge of the canopy, or inside the front crossbeam and rear crossbeam (if the front crossbeam and rear crossbeam are tubular) and then rolled in the canopy. The rolled sunshade may then be held in a rolled position with ties and/or placed in a carrying bag for easy transportation.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
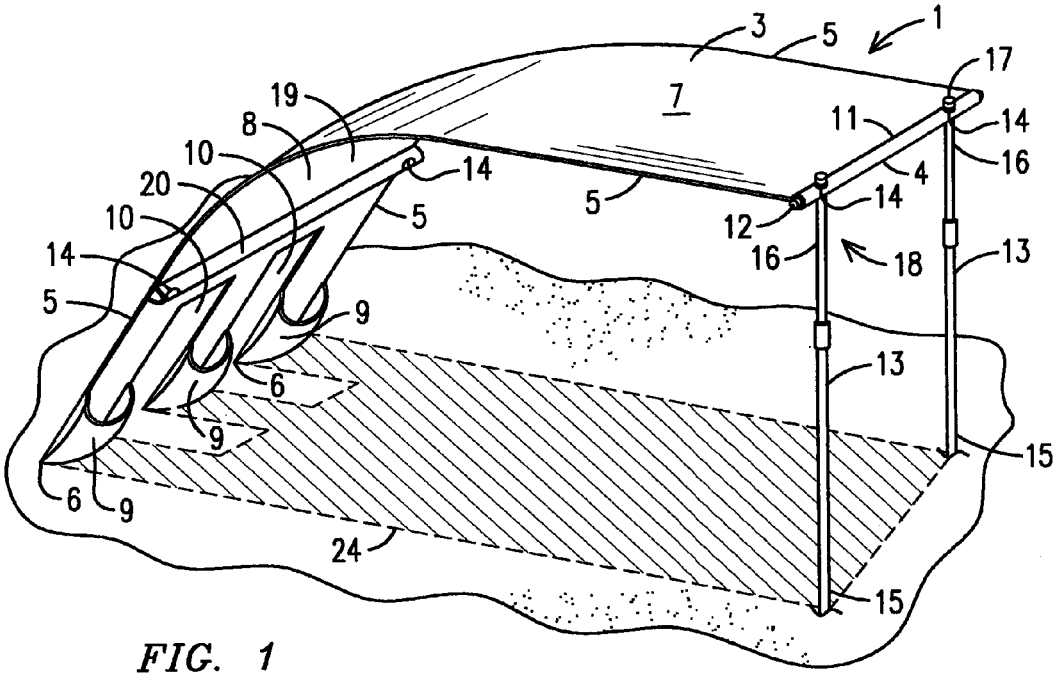
FIG. 1 is a perspective side view of a collapsible sunshade of the present invention without a rear support structure.
Figure 2:
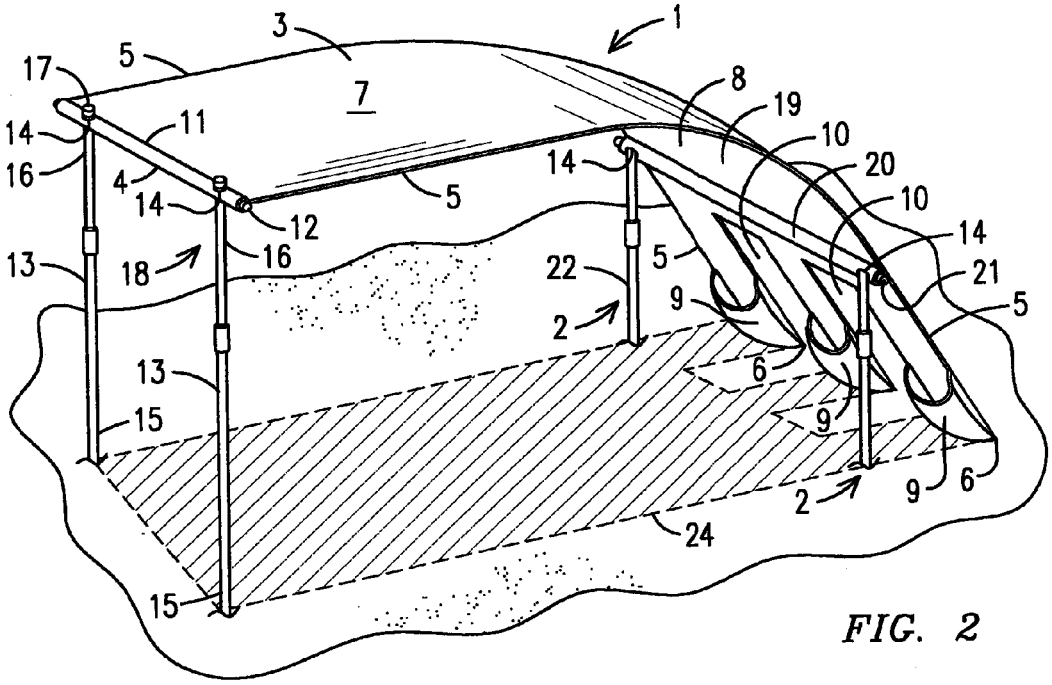
FIG. 2 is a perspective side view of a collapsible sunshade of the present invention with a rear support structure.

For purposes of describing the preferred embodiment, the terminology used in reference to the numbered components in the drawings is as follows:

1. collapsible sunshade, generally
2. rear support structure
3. canopy
4. front edge of canopy
5. side edge of canopy
6. rear edge of canopy
7. top surface of canopy
8. bottom surface of canopy
9. pocket
10. air vent
11. front sleeve
12. front crossbeam
13. front support pole
14. aperture
15. proximal end of front support pole
16. distal end of front support pole
17. locking means
18. front support structure
19. rear portion of canopy
20. rear sleeve
21. rear crossbeam
22. rear support pole
23. anchor
24. shaded portion With reference to FIGS. 1 and 2, perspective side views of a collapsible sunshade 1 of the present invention without a rear support structure 2 and with a rear support structure 2, respectively, are illustrated. The collapsible sunshade 1 of the present invention comprises a substantially-rectangular shaped canopy 3 having a front edge 4, side edges 5, a rear edge 6, a top surface 7 and a bottom surface 8. One or more pockets 9 are located proximal to the rear edge 6 of the canopy 3. The pockets 9 may be filled with sand or other substances such as gravel to anchor the rear edge 6 of the collapsible sunshade 1 to the ground. One or more air vents 10 may also be located proximal to the rear edge 6 to allow wind to pass through, thereby lessening the pressure of the wind on the bottom surface 8 of the canopy 3. A front sleeve 11 is located along the front edge 4 of the canopy 3 and houses a front crossbeam 12. One or more front support poles 13 attach to the front crossbeam 12 by passing through one or more apertures 14 located on the front sleeve 11 and the front crossbeam 12. The one or more front support poles 13 may be telescoping to allow a user to adjust the height of the front crossbeam 12. In addition, each front support pole 13 comprises a proximal end 15 that is inserted directly into the ground or into the ground using an anchor 23 (as illustrated in FIG. 10) and a distal end 16 that passes through the one or more apertures 14 located on the front sleeve 11 and the front crossbeam 12. A locking means 17 such as a clamp, threaded connection, threaded cap, threaded nut and so forth may attach to the distal ends 16 of the front support poles 13 to prevent the distal ends 16 from disconnecting from the front crossbeam 12. The front crossbeam 12 and one or more front support poles 13 comprise the front support structure 18, as further illustrated in FIGS. 4 and 5. For additional support, a rear portion 19 of the canopy may have a rear sleeve 20 extending between the side edges 5 of the canopy 3 that houses a rear crossbeam 21. One or more rear support poles 22 attach to the rear crossbeam 21 by passing through one or more apertures 14 located on the rear sleeve 20 and the rear crossbeam 21. The one or more rear support poles 22 may also be telescoping to allow a user to adjust the height of the rear crossbeam 21. The rear crossbeam 21 and one or more rear support poles 22 comprise a rear support structure 2, as further illustrated in FIG. 6. When erected, the collapsible canopy 1 provides a shaded portion 24 for the user.

Figure 3:
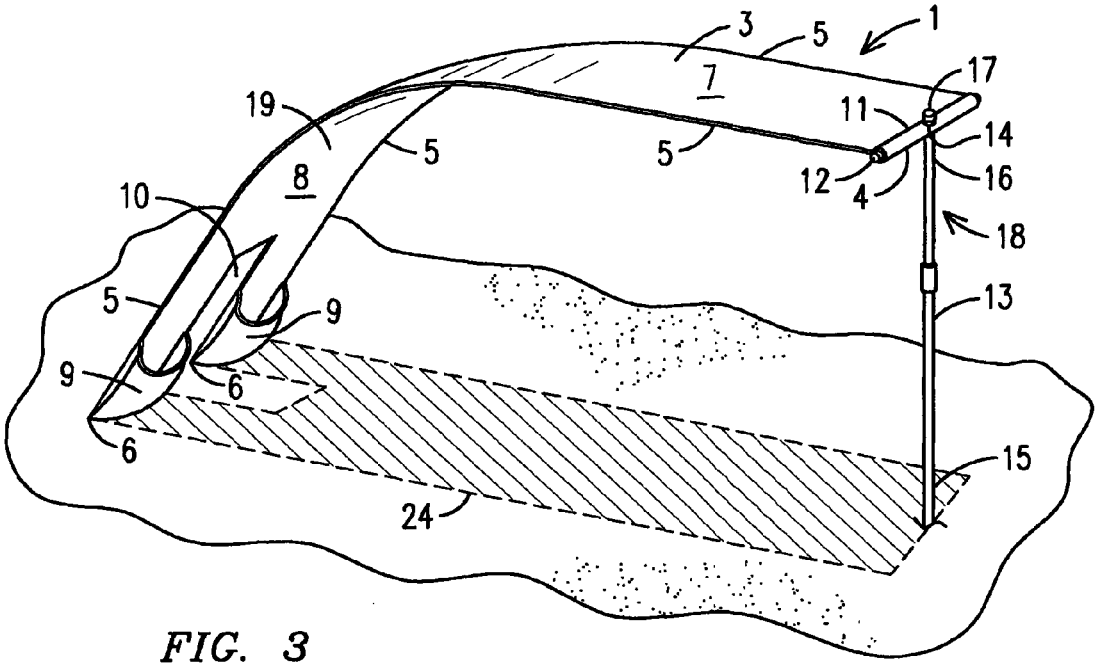
FIG. 3 is a perspective side view of a collapsible sunshade of the present invention having a single front support pole.

With reference to FIG. 3, a perspective side view of a collapsible sunshade 1 of the present invention having a single front support pole 13 is illustrated. The number of front support poles 13 necessary for supporting the front crossbeam 12 is dependent on the size of the collapsible sun shade 1. As illustrated here, the collapsible sunshade 1 is sized for a single user. Therefore, only one front support pole 13 positioned centrally on the front cross beam 12 is necessary to support the front cross beam 12. When erected, the collapsible canopy 1 provides a shaded portion 24 for the user.

Figure 4:
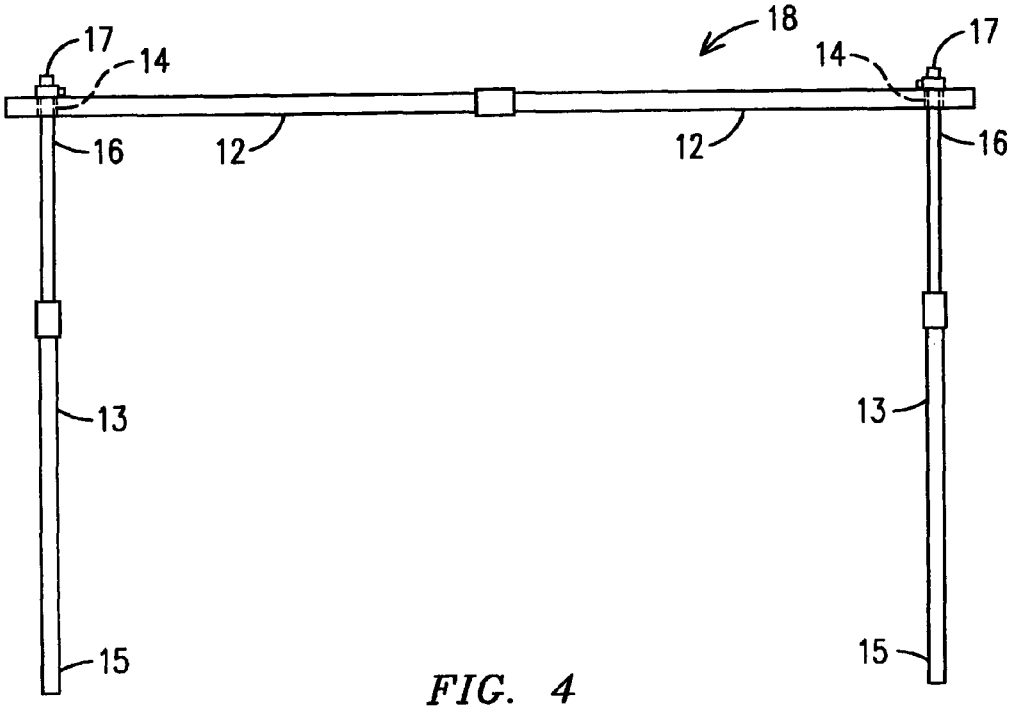
FIG. 4 is a front view of a front support structure having a multiple front support poles.
Figure 5:
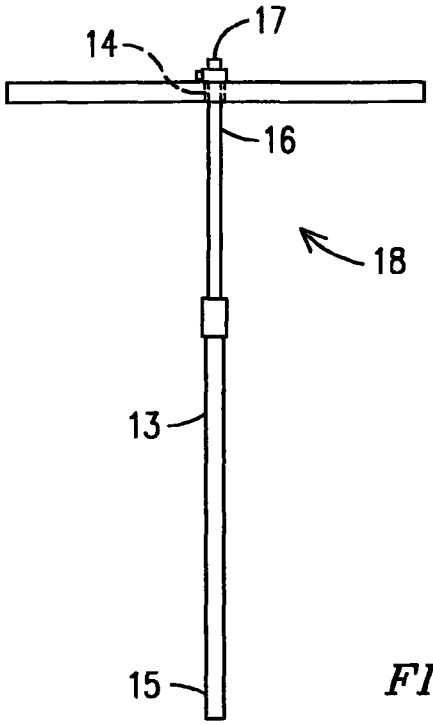
FIG. 5 is a front view of a front support structure having a single front support poles.

With reference to FIGS. 4 and 5, a front view of a front support structure 18 having a multiple front support poles 13 and a front support structure 18 having a single front support pole 13, respectively, are illustrated. One or more front support poles 13 attach to the front crossbeam 12 by passing through one or more apertures 14 located on the front crossbeam 12. The one or more front support poles 13 may be telescoping to allow a user to adjust the height of the front crossbeam 12. In addition, each front support pole 13 comprises a proximal end 15 that is inserted directly into the ground or into the ground using an anchor (as illustrated in FIG. 10) and a distal end 16 that passes through the one or more apertures 14 located on the front crossbeam 12. A locking means 17 such as a clamp, threaded connection, threaded cap, threaded nut and so forth may attach to the distal ends 16 of the front support poles 13 to prevent the distal ends 16 from disconnecting from the front crossbeam 12. The number of front support poles 13 necessary for supporting the front crossbeam 12 is dependent on the size of the collapsible sun shade 1. For example, the front support structure 18 illustrated in FIG. 4 would be used with a larger collapsible sunshade for use by multiple individuals, as illustrated in FIGS. 1 and 2, and the front support structure 18 illustrated in FIG. 5 would be used with a smaller collapsible sunshade for use by a single individual, as illustrated in FIG. 3.

Figure 6:
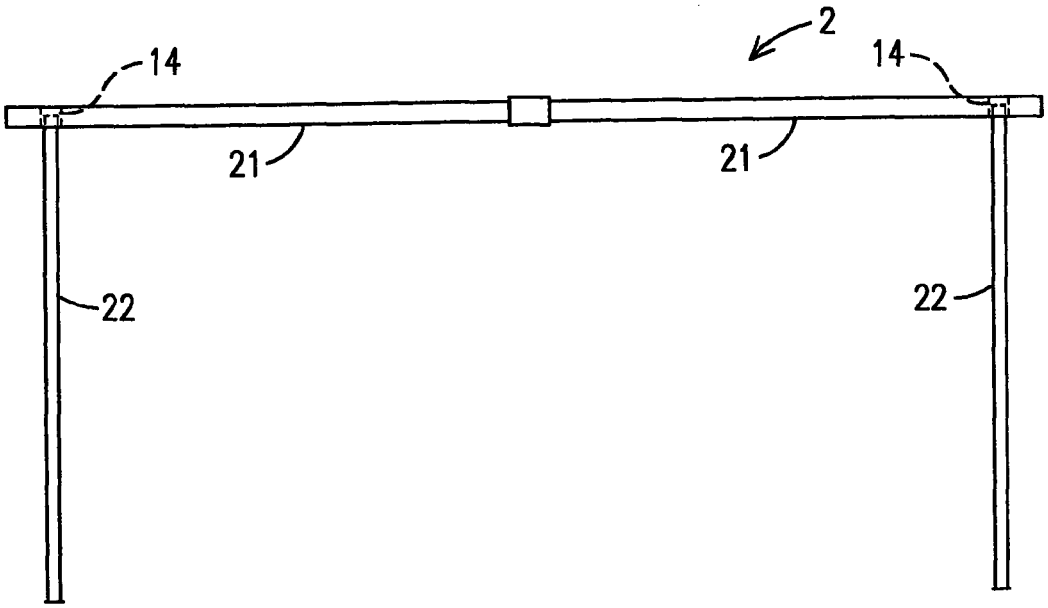
FIG. 6 is a front view of a rear support structure of the present invention.

With reference to FIG. 6, a front view of a rear support structure 2 of the present invention is illustrated. For additional support, a rear portion 19 of the canopy may have a rear sleeve 20 extending between the side edges 5 of the canopy 3, as illustrated in FIGS. 1 and 2, that houses a rear crossbeam 21. One or more rear support poles 22 attach to the rear crossbeam 21 by passing through one or more apertures 14 located on the rear sleeve 20 and the rear crossbeam 21.

Figure 7:
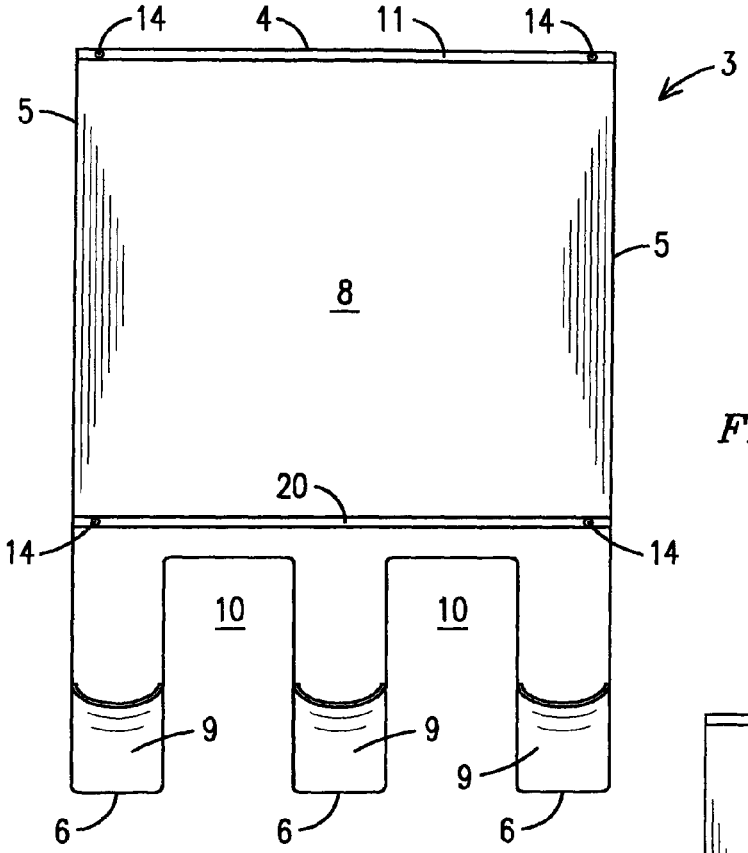
FIG. 7 is a bottom view of the canopy illustrated in FIGS. 1 and 2.

With reference to FIG. 7, a bottom view of the canopy 3 illustrated in FIGS. 1 and 2 is illustrated. The substantially-rectangular shaped canopy 3 having a front edge 4, side edges 5, a rear edge 6 a top surface 7 and a bottom surface 8. One or more pockets 9 are located proximal to the rear edge 6 of the canopy 3. One or more air vents 10 may also be located proximal to the rear edge 6 to allow wind to pass through, thereby lessening the pressure of the wind on the bottom surface 8 of the canopy 3. A front sleeve 11 is located along the front edge 4 of the canopy 3 with one or more apertures 14 located thereon. A rear sleeve 20 extends between the side edges 5 of the canopy 3 with one or more apertures 14 located thereon.

Figure 8:
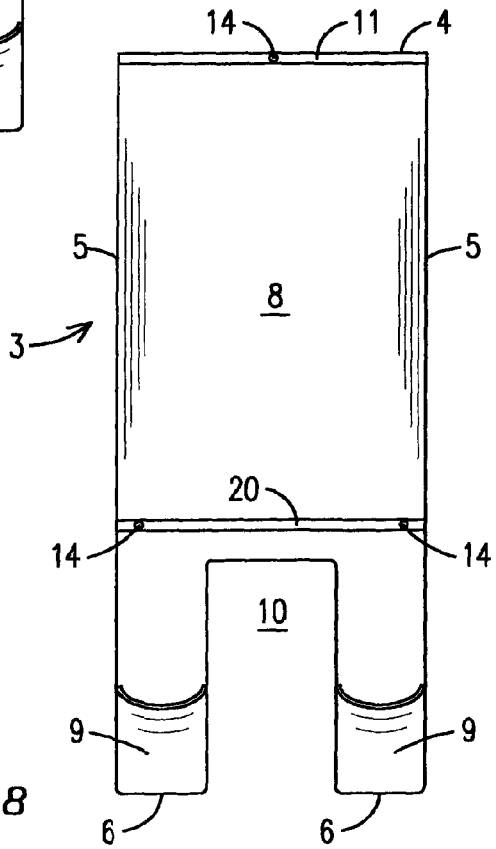
FIG. 8 is a bottom view of the canopy illustrated in FIG. 3.

With reference to FIG. 8, a bottom view of the canopy 3 illustrated in FIG. 3 is illustrated. The substantially-rectangular shaped canopy 3 comprises a front edge 4, side edges 5, a rear edge 6, a top surface 7 and a bottom surface 8. One or more pockets 9 are located proximal to the rear edge 6 of the canopy 3. One or more air vents 10 may also be located proximal to the rear edge 6 to allow wind to pass through, thereby lessening the pressure of the wind on the bottom surface 8 of the canopy 3. A front sleeve 11 is located along the front edge 4 of the canopy 3 with an aperture 14 located centrally thereon. A rear sleeve 20 extends between the side edges 5 of the canopy 3 with one or more apertures 14 located thereon.

Figure 9:
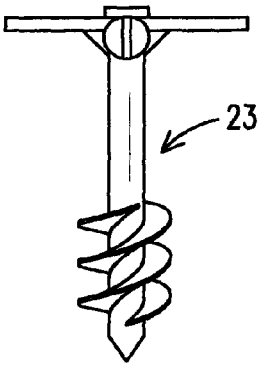
FIG. 9 is a side view of an anchor for securing the proximal ends of the one or more front support poles and/or the one or more rear support poles.

With reference to FIG. 9, a side view of an anchor 23 for securing the proximal ends of the one or more front support poles 13 and/or the one or more rear support poles 22 is illustrated. The anchor 23 screws into the ground and provides a base to hold the proximal ends of the one or more front support poles 13 and/or the one or more rear support poles 22.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A collapsible sunshade comprising:

a substantially rectangular shaped canopy having a front edge, side edges, a rear edge, a top surface and a bottom surface;

one or more pockets each having side edges attached to said canopy and a lower edge attached to said canopy to create an interior space accessible by an opening located on a top edge of said one or more pockets designed to receive weight to anchor the rear edge of the substantially rectangular shaped canopy;

said one or more pockets each being located superior to the rear edge of the substantially rectangular shaped canopy in a manner in which the lower edge of each one or more pockets is parallel to said rear edge of the canopy so when the one or more pockets are filled with sand, the rear edge of the canopy is held down under the weight of the sand; and a front support structure attached near the front edge of the substantially rectangular shaped canopy;

a front sleeve located along the front edge of the substantially rectangular shaped canopy;

said front support structure further comprising a front crossbeam that is housed by the front sleeve of the substantially rectangular shaped canopy and a front support pole attached to a center of the front crossbeam to create a substantially T-shaped front support structure and said substantially rectangular shaped canopy being unsupported by any structure except along the front edge.

2. The collapsible sunshade of claim 1 wherein:

said front support pole has a proximal end and a distal end; and said distal end of the at least one front support pole attaches the front crossbeam by passing through a corresponding aperture located on the front sleeve and a corresponding aperture located on the crossbeam.

3. The collapsible sunshade of claim 2 wherein:

said distal end of the at least one front support pole is further secured to the front crossbeam using a locking means.

4. The collapsible sunshade of claim 1 wherein:

said front support pole is telescoping.

5. The collapsible sunshade of claim 1 further comprising:

at least one air vent located near a rear portion of the substantially rectangular shaped canopy.

6. A collapsible sunshade comprising:

a substantially rectangular shaped canopy having a front edge, side edges, a rear edge, a top surface and a bottom surface;

one or more pockets each having side edges attached to said canopy and a lower edge attached to said canopy to create an interior space accessible by an opening located on a top edge of said one or more pockets designed to receive weight to anchor the rear edge of the substantially rectangular shaped canopy;

said one or more pockets each being located superior to the rear edge of the substantially rectangular shaped canopy in a manner in which the lower edge of each one or more pockets is parallel to said rear edge of the canopy so when the one or more pockets are filled with sand, the rear edge of the canopy is held down under the weight of the sand;

a front sleeve located along the front edge of the substantially rectangular shaped canopy;

a front crossbeam that is housed by the front sleeve of the substantially rectangular shaped canopy;

a front support pole attached to a center of the front crossbeam said front support pole has a proximal end and a distal end;

said distal end of the front support pole attaches to the front crossbeam by passing through a corresponding aperture located on the front sleeve and a corresponding aperture located on the crossbeam to create a substantially T-shaped support structure;

at least one air vent located near a rear portion of the substantially rectangular shaped canopy between the two or more pockets so that when wind blows against the bottom surface of the canopy upward tension is provided on the top edges of the two or more pockets; and said substantially rectangular shaped canopy being unsupported by any structure except along the front edge.

7. The collapsible sunshade of claim 6 wherein:

said distal end of the at least one front support pole is further secured to the front crossbeam using a locking means.

8. The collapsible sunshade of claim 6 wherein:

said front support pole is telescoping.

9. A collapsible sunshade comprising:

a substantially rectangular shaped canopy having a front edge, side edges, a rear edge, a top surface and a bottom surface;

one or more pockets each having side edges attached to said canopy and a lower edge attached to said canopy to create an interior space accessible by an opening located on a top edge of said one or more pockets designed to receive weight to anchor the rear edge of the substantially rectangular shaped canopy;

said one or more pockets each being located superior to the rear edge of the substantially rectangular shaped canopy in a manner in which the lower edge of each one or more pockets is parallel to said rear edge of the canopy so when the one or more pockets are filled with sand, the rear edge of the canopy is held down under the weight of the sand;

a front sleeve located along the front edge of the substantially rectangular shaped canopy;

a front crossbeam that is housed by the front sleeve of the substantially rectangular shaped canopy;

a front support pole attached to a center of the front crossbeam;

said front support pole having a proximal end and a distal end;

said distal end of the front support pole attaches to the front crossbeam by passing through a corresponding aperture located on the front sleeve and a corresponding aperture located on the crossbeam to create a substantially T-shaped support structure;

at least one air vent located near a rear portion of the substantially rectangular shaped canopy between the two or more pockets so that when wind blows against the bottom surface of the canopy upward tension is provided on the top edges of the two or more pockets;

said substantially rectangular shaped canopy being unsupported by any structure except along the front edge and the rear edge; and said front support pole is telescoping.

* * * * *